US006660378B2

(12) United States Patent
Chizmas et al.

(10) Patent No.: US 6,660,378 B2
(45) **Date of Patent: *Dec. 9, 2003**

(54) GLOW-IN-THE-DARK ANIMAL TIE-OUT

(75) Inventors: Jeffrey J. Chizmas, Saugus, MA (US); Gregory C. Gitto, Fitchburg, MA (US)

(73) Assignee: Aspen Pet Products, Inc., Denver, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/299,224

(22) Filed: Apr. 23, 1999

(65) Prior Publication Data

US 2002/0061399 A1 May 23, 2002

Related U.S. Application Data

(60) Provisional application No. 60/082,769, filed on Apr. 23, 1998.

(51) Int. Cl.[7] ..... D02G 3/00; B60P 3/04

(52) U.S. Cl. ..... 428/372; 428/375; 428/377; 428/379; 428/383; 428/395; 428/393; 119/400

(58) Field of Search ..... 174/112; 428/379, 428/383, 372, 377, 394, 395, 375; 119/400

(56) References Cited

U.S. PATENT DOCUMENTS

| | | | | | |
|---|---|---|---|---|---|
| 2,009,004 | A | * | 7/1935 | Schatzel | 174/112 |
| 2,945,265 | A | * | 7/1960 | Sell, Jr. et al. | 174/112 |
| 3,663,359 | A | * | 5/1972 | Briam | 174/112 |
| 3,871,336 | A | * | 3/1975 | Bergman | 359/516 |
| 4,161,564 | A | * | 7/1979 | Legbandt | 174/112 |
| 4,423,306 | A | * | 12/1983 | Fox | 174/112 |
| 4,579,759 | A | * | 4/1986 | Breuers | 174/112 |
| 5,142,105 | A | * | 8/1992 | Kihlken et al. | 174/112 |
| 5,281,764 | A | * | 1/1994 | King et al. | 174/112 |
| 5,286,922 | A | * | 2/1994 | Curtiss | 174/112 |
| 5,357,058 | A | * | 10/1994 | Tanihira et al. | 174/112 |
| 5,753,381 | A | * | 5/1998 | Feldman et al. | 428/690 |
| 5,876,863 | A | * | 3/1999 | Feldman et al. | 428/690 |
| 5,945,632 | A | * | 8/1999 | Butera | 174/36 |
| 6,207,077 | B1 | * | 3/2001 | Burnell-Jones | 252/301.36 |
| 6,408,793 | B1 | * | 6/2002 | Rutter | 119/400 |
| 2001/0010367 | A1 | * | 8/2001 | Burnell-Jones | 252/301.36 |
| 2002/0061399 | A1 | * | 5/2002 | Chizmas et al. | 428/375 |
| 2002/0162516 | A1 | * | 11/2002 | Rutter | 199/400 |

FOREIGN PATENT DOCUMENTS

| | | | |
|---|---|---|---|
| GB | 2316354 | * | 2/1998 |
| JP | 10219119 | * | 8/1998 |
| JP | 11032421 | * | 2/1999 |
| WO | WO 99/48995 | * | 9/1999 |
| WO | WO99/48995 | * | 9/1999 |
| WO | WO 01/35729 A3 | * | 5/2001 |

OTHER PUBLICATIONS

Permaglow Technical Data Sheet Hirotec, Inc.,.*

* cited by examiner

*Primary Examiner*—Cynthia H. Kelly
*Assistant Examiner*—J. M. Gray
(74) *Attorney, Agent, or Firm*—Dorsey & Whitney LLP

(57) ABSTRACT

A cable includes a structural core and an outer layer having glow-in-the-dark properties. In an advantageous embodiment, there is provided a cable of coaxially laminated structure, which includes a structural core, an inner layer surrounding the structural core, and an outer layer, or "skin", surrounding the inner layer and having glow-in-the-dark properties. The inner layer presents a light colored or reflective outer surface such that a major portion of incident light striking the surface is reflected back.

11 Claims, 1 Drawing Sheet

GLOW-IN-THE-DARK ANIMAL TIE-OUT

CROSS REFERENCE TO RELATED APPLICATIONS

This application claims the benefit of U.S. Provisional Application No. 60/082,769 filed Apr. 23, 1998 entitled GLOW-IN-THE-DARK COATED CABLE.

BACKGROUND OF THE INVENTION

The present invention relates generally to coated cables, and more particularly, to thermoplastic coated cables for use in applications in which enhanced visibility of same is advantageous, such as in support cables, animal tie-outs and restraints, fences, barriers and walkways.

The prior art does not adequately address the need for a coated cable which, by virtue of visual properties, could provide improved viewability, particularly at night or when used in a darkened indoor application.

OBJECTS AND SUMMARY OF THE INVENTION

It is an object of the invention to provide a coated cable which overcomes the drawbacks of the prior art.

It is a further object of the invention to provide a coated cable which provides enhanced viewability at night or in darkened surroundings.

It is a still further object of the invention to provide a coated cable with glow-in-the-dark properties such that it emits visible light in a darkened setting over an extended period of time after exposure to ambient light or other naturally or artificially applied light source.

It is a yet a further object of the invention to provide a cable with such properties in a manner which is cost effective such that a product fashioned from such cable material will be economically feasible.

Briefly stated, there is provided a cable comprised of a structural core made of twined wire or other suitable material, including for example natural or man-made non-metallic rope or filament such as cotton, hemp, nylon, etc., advantageously providing desirable flexibility and sufficient tensile strength for the particular application to which the completed cable is directed. The cable further includes an outer layer surrounding the structural core, such outer layer having glow-in-the-dark properties. The outer layer is of a material comprised of an advantageously homogeneous mixture of a suitably resilient thermoplastic and a granulated or powderized material which emits light in a darkened environment after exposure to light. A coloring agent compatible with the glow-in-the-dark component, i.e. free of components which might otherwise decay the light emissive properties thereof, may optionally be added to increase visual vibrancy in lighted situations and also to enhance the aesthetic appeal in light and dark situations as desired.

In a particularly advantageous embodiment, there is provided a cable of coaxially laminated structure, which includes a structural core as described above, an inner layer surrounding the structural core, and an outer layer, or "skin", surrounding the inner layer. The inner core presents a light colored or reflective outer surface such that a major portion of incident light striking the surface is reflected back. This is accomplished conveniently by comprising the inner core of a white pigmented thermoplastic composition, advantageously opaque to mask the central structural core. Such white pigment may include for example titanium dioxide. Optionally, an optical brightener may be added to the thermoplastic composition of the inner layer to increase incident light reflectivity. Alternatively, a lightly colored or reflective coating may be applied to the inner layer, the actual color of which is therefore inconsequential. This may be in the form of paint, die, applied tape or the like. The outer layer or "skin" disposed coaxially about the inner layer which includes the light reflective coating, if such is used, is comprised of a thermoplastic composition which includes a material advantageously dispersed homogeneously therethrough, and which imparts glow-in-the-dark properties thereto. As noted above herein, a coloring agent compatible with the glow-in-the-dark component may optionally be added to the composition comprising the outer layer so as not to decay the light emissive properties thereof. The outer layer may be relatively thin compared with a cross-sectional diameter of the overall cable structure, and in fact is advantageously thin enough to provide translucency, thereby permitting light transmission from an outer surface thereof to the inner light enhancing layer. By reducing the amount of material used for the outer glow-in-the-dark layer, such embodiment has the advantage of economy, given the relatively high cost of the light emissive additive.

The various embodiments as disclosed herein may be conveniently produced by a cable extrusion process in which a structural core, for example a length of galvanized steel aircraft wire, is drawn through one or more suitably configured cross-heads fed by one or more extruders, the later which heat a thermoplastic to a flowable state, and the former which coat the cable core passing therethrough.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
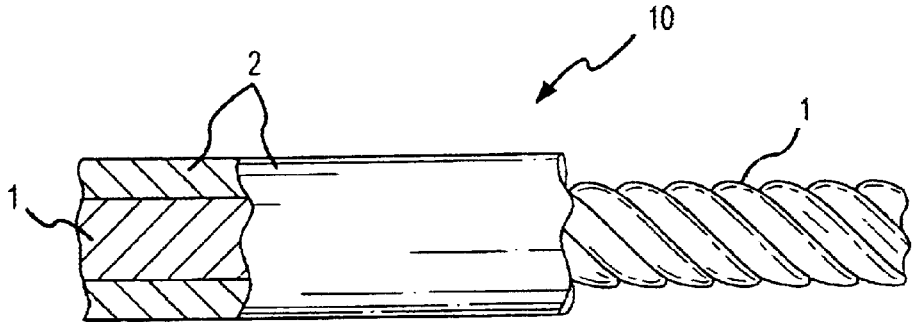
FIG. 1 is a side elevation of a coated cable in accordance with an embodiment of the invention.

Referring now to the figures, and in particular FIG. 1, there is depicted, in accordance with the invention, a coated cable, generally designated 10. Coated cable 10 includes a structural core 1 made of suitable material of longitudinally extended configuration, advantageously providing desirable flexibility and sufficient tensile strength for the particular application to which the completed cable is directed. In the illustrated example, structural core 1 is 7×7 galvanized steel aircraft cable, comprised of seven twisted stranded components, each themselves comprised of seven twisted wires. An outer layer 2 coaxially surrounds structural core 1, and is comprised of a material presenting glow-in-the-dark properties and having properties, i.e. flexibility, resiliency, insulative characteristics, etc., suitable for use with the cable application to which coated cable 10 is to be directed. The material comprising outer layer 2 advantageously comprises, for example, a thermoplastic composition which includes a homogeneous mixture of a common clear PVC (polyvinyl chloride polymer) and a glow-in-the-dark component, comprising one or more materials imparting or enhancing glow-in-the-dark properties, including for example, zinc sulfide, copper chloride, etc. In the disclosed example, the glow-in-the-dark compound is a crystalline powderized substance available from Hirotec, Inc. under the trade name PERMAGLOW. The substance is added to the common PVC in an advantageous weight range of from about 5% to about 12%. Optionally, a coloring agent, i.e. a pigment compatible with the glow-in-the-dark component, may be added in a minor amount to the PVC composition to impart a desired color, for added visibility and user appeal under normal lighted conditions. The above compound is available, for example, premixed with a pigment, and wherein such pigment comprises by weight about 3% of such glow-in-the-dark compound. In selecting a suitable pigment, the material must be of a type, and added in a percentage, which will not adversely affect or decay the glow-in-the-dark properties of the active ingredient.

Figure 2:
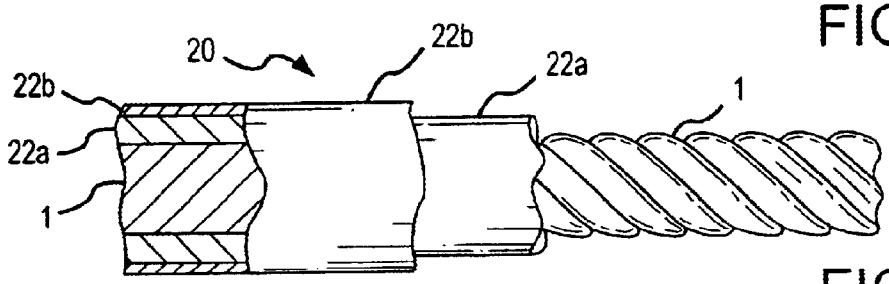
FIG. 2 is a side elevation of a coated cable in accordance with another embodiment of the invention.

Turning now to FIG. 2, a coated cable is depicted in which the outer coating is comprised of coaxially disposed laminated structure, the coated cable generally designated 20. Cable 20 includes structural core 1 in accordance with the previously described embodiment. Coaxially disposed about structural core 1 is an inner layer 22*a* comprised of a material having properties, i.e. flexibility, resiliency, insulative characteristics, etc., suitable for use with the cable application to which coated cable 10 is to be directed. For example, inner layer 22*a* may be comprised of a thermoplastic composition which includes common PVC. The outer surface of inner layer 22*a* advantageously presents an opaque white, lightly colored or reflective appearance such that a major portion of light incident upon such surface is reflected therefrom. This is accomplished conveniently by adding a white pigment, such as for example titanium dioxide, to the PVC composition in a homogeneous mixture, such that inner layer 22*a* exhibits a uniform white color throughout. An optical brightener is advantageously added to enhance the appearance of white, and increase perceived reflectivity brightness. Alternative to this approach, inner layer 22*a* may be coated with a bright colored or reflective paint or dye, or may have white or reflective tape applied thereto, to achieve the bright surface.

Cable 20 further includes an outer layer or "skin" 22*b*, coaxially disposed about inner layer 22*a*. Outer layer 22*b* is comprised of the same components as the composition used for outer layer 2 in the embodiment described with reference to FIG. 1. Outer layer 22*b* may be relatively thin compared with a cross-sectional diameter of the overall cable structure, and in fact is advantageously thin enough to provide some translucency, thereby permitting light transmission from an outer surface thereof to the inner, light enhancing inner layer 22*a*. By reducing the amount of material used for the outer, glow-in-the-dark layer 22*b*, such embodiment has the advantage of economy, given the relatively high cost of the active glow-in-the-dark component additive.

Figure 3:
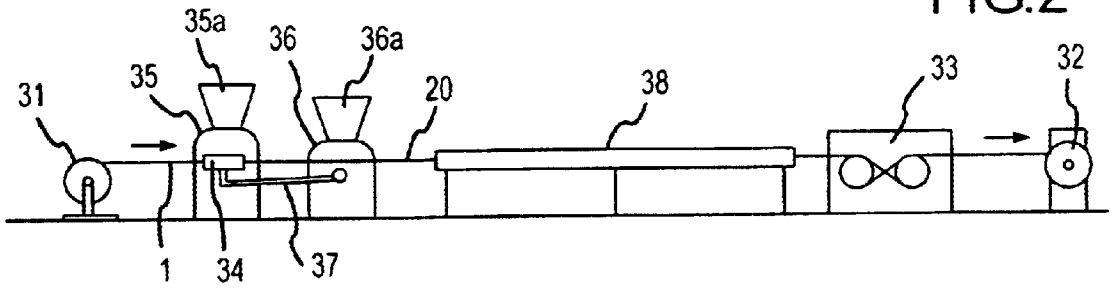
FIG. 3 is a schematic representation of a typical cable extrusion operation for producing the various embodiments of the coated cable in accordance with the invention.
Figure 4:
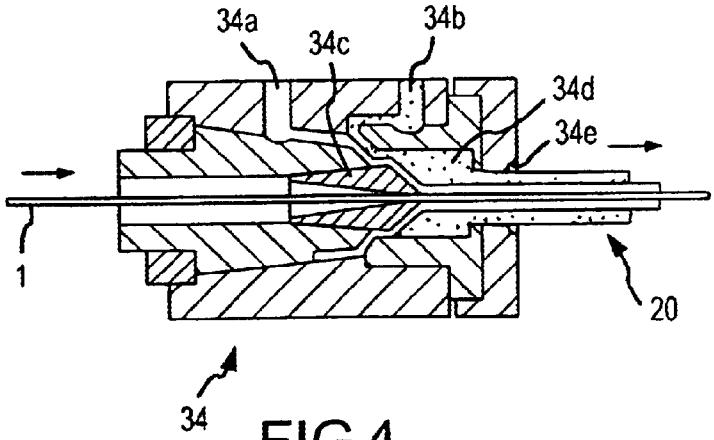
FIG. 4 is a cross-sectional side view of a specialized cross head for co-extrusion of a laminated cable structure in accordance with the embodiment of FIG. 2.

The various embodiments in accordance with the invention are conveniently produced in practice by modifying extrusion practices commonly employed in the production of coated cables. An example of such extrusion process is depicted schematically in FIG. 3, wherein a cable extends between a payoff roll 31 and a take-up roll 32, driven in the direction of the arrows by a motor-driven capstan 33. The production line depicted is directed to co-extrusion of coated cable 20 of the embodiment described with reference to FIG. 2. As shown, uncoated structural cable core 1 is passed through an extrusion cross-head 34 fed by a main extruder 35 and a co-extruder 36. Main extruder 35 and a co-extruder 36 include hoppers 35*a* and 36*a*, respectively, in which is received the appropriate composition to be melted and transferred under pressure to the appropriate port in cross-head 34 for extrusion about cable core 1. Cross-head 34 is shown in detail in FIG. 4, and includes a main port 34*a* for receiving material comprising inner layer 22*a*, and a co-extrusion port 34*b* for receiving material comprising outer layer 22*b* and fed through a connecting line 37 from co-extruder 36. As shown in FIG. 4, cable core 1 passes through a tip 34*c* configured to center cable core 1 in cross-head 34 and prevent backflow of pressurized thermoplastic within a "gum space" 34*d* prior to extrusion through a die 34*e*. Once exiting cross-head 34, coated cable 20 passes through a water trough 38, where it is cooled prior to winding about take-up roll 32. It is noted that standard extrusion practices are modified to the extent that the extruder used for heating and transferring the glow-in-the-dark material for outer layer 22*b* (or for outer layer 2 where a single extrusion is practiced in analogous fashion) does not utilize a screen which is normally present at an output region thereof, inasmuch as such screen would filter out the crystals of active glow-in-the-dark additive.

Dimensions of a completed cable in accordance with various embodiments as contemplated herein are not critical to the invention, and will be determined by the particular application to which the cable is directed. When used as an animal tie-out, for example, a structural core of galvanized steel having a diameter of about ⅛" and a coating layer having a thickness of about 40 mils (0.040") has been found suitable. Where such tie-out example includes an inner and outer layer, as in the embodiment of FIG. 2, the O.D. of the structural core is for example about 0.125", the O.D. of the inner layer is about 0.185" and the O.D. of the outer layer is about 0.210".

It is noted that although the previously described embodiments refer to an outer layer 2 and 22*b*, respectively, such outer layers do not necessarily have to be the outermost layers of a cable configuration in accordance with the invention within the contemplated scope herein. For example, either embodiment may be further coated with a light transmissive additional coating over the outer coating 2 or 22*b*, to provide further protection against environmental wear of the light-active layer, without departure from the invention. Furthermore, a UV protective agent may be included in the various compositions comprising the corresponding layers of the complete cable coating structure to inhibit light-induced degradation over time.

It is further noted that although the cable disclosed herein will find a wide range of application, the invention is deemed particularly advantageous for use as a pet tie-out, wherein by providing enhanced cable visibility, the incidence of a pet owner or child accidentally tripping on the tie-out in low light conditions is reduced. Use of the claimed cable structure is also advantageously applied to construction of barriers and guard rails comprised at least in part of a cable structure to thereby improve highway safety, and as a support cable to tie down or otherwise secure aircraft, in which regard visibility to other aircraft on an airfield is essential for reducing accidents.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An animal tie-out comprising:

a structural core selected from the group consisting of: steel, cotton, hemp, and nylon; and an extruded thermoplastic layer coaxially surrounding said core, said thermoplastic layer being formed from a composition comprising a thermoplastic carrier and from 5% to 12% by weight of a material dispersed therein, said material emitting visible light over an extended period of time after exposure to a light source.

2. The animal tie-out according to claim 1, wherein said carrier includes clear polyvinyl chloride polymer.

3. The animal tie-out according to claim 1, wherein said composition of said layer further includes a coloring agent.

4. The animal tie-out according to claim 1, wherein said material emitting visible light includes at least one element selected from the group consisting of zinc sulfide and copper chloride.

5. The animal tie-out according to claim 1, wherein said layer includes an ultraviolet protective agent.

6. The animal tie-out according to claim 1, further comprising a protective outer layer disposed about said layer.

7. An animal tie-out comprising:

a flexible, twisted, multi-stranded core selected from the group consisting of: steel, cotton, hemp, and nylon;

an extruded thermoplastic layer coaxially surrounding said core, said thermoplastic layer being formed from a composition comprising a thermoplastic carrier and glow-in-the dark material dispersed therein; and an inner layer coaxially interposed between said core and said thermoplastic layer, said inner layer including an outer surface reflecting a majority of light striking said outer surface.

8. The animal tie-out according to claim 7, wherein said outer surface is chosen from the group consisting of opaque white, lightly colored and reflective surfaces.

9. The animal tie-out according to claim 7, wherein said inner layer is formed a composition including a mixture of a thermoplastic and a white pigment.

10. The animal tie-out according to claim 9, wherein said inner layer composition further includes an optical brightener.

11. The animal tie-out according to claim 7, wherein said outer surface comprises a coating chosen from the group consisting of a paint, a dye, and a tape.

* * * * *